US008725008B2

(12) United States Patent
Kott et al.

(10) Patent No.: US 8,725,008 B2
(45) Date of Patent: May 13, 2014

(54) USING IMAGES TO DIAGNOSE DEFECTS IN AN IMAGE FORMING APPARATUS

(75) Inventors: Gregory J. Kott, Fairport, NY (US); Jorge Antonio Alvarez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 407 days.

(21) Appl. No.: 12/724,470

(22) Filed: Mar. 16, 2010

(65) Prior Publication Data

US 2011/0228307 A1 Sep. 22, 2011

(51) Int. Cl.
*G03G 15/00* (2006.01)

(52) U.S. Cl.
USPC ..... 399/9

(58) Field of Classification Search
USPC ..... 358/1.14, 1.15, 16, 1.16; 714/25; 399/9
See application file for complete search history.

(56) References Cited

U.S. PATENT DOCUMENTS 6,032,004 A 2/2000 Mirabella, Jr. et al.
6,163,778 A * 12/2000 Fogg et al. ..... 1/1
6,912,674 B2 6/2005 Trelewicz et al.
2007/0008369 A1* 1/2007 Suzuki ..... 347/19
2008/0240741 A1* 10/2008 Sasama et al. ..... 399/9
2008/0294423 A1 11/2008 Castellani et al.
2009/0024950 A1* 1/2009 Salgado et al. ..... 715/772
2010/0020361 A1 1/2010 Kim et al.

FOREIGN PATENT DOCUMENTS

JP 8292859 11/1996
JP 2001333886 12/2001

* cited by examiner

*Primary Examiner* — Eric A Rust
(74) *Attorney, Agent, or Firm* — Gibb & Riley, LLC

(57) ABSTRACT

Methods and systems receive printing symptoms from a user into a graphic user interface and receive system information from a printing device exhibiting the printing symptoms. The method analyzes the printing symptoms using a diagnostic inference system operating on a computerized device operatively connected to the graphic user interface to produce candidate component defects. The method outputs diagnostic recommendations containing the candidate component defects to the user. The diagnostic recommendations include at least one representative image of a printing defect corresponding to each candidate component defect, and probabilities of correctness of the candidate component defects displayed alongside the representative image.

16 Claims, 4 Drawing Sheets

USING IMAGES TO DIAGNOSE DEFECTS IN AN IMAGE FORMING APPARATUS

BACKGROUND AND SUMMARY

Embodiments herein generally relate to methods and systems that diagnose printer defects and more particularly to systems and methods that provide the user with images of candidate defects that the user can use for comparison purposes to narrow or identify the defective component within the printer.

Failure in printers and copiers typically manifest themselves in defects seen on the printed image. Image quality defects typically account for more than 50% of system failures requiring service in the field and creating downtime for organizations running printers and copiers.

One common method often used to diagnose printer image quality defects is to evaluate standard image reference (SIR) images stored at the printer location. The primary goal when viewing the standard image references is to evaluate the severity of the defect. Additionally, the service agent or customer may scan through all standard image references created for the printing system to help diagnose and isolate the defective component.

A dynamic diagnostic image as described in this disclosure provides the customer the results from a diagnostic inference engine and a visual verification of the current defect compared to a library of defects for the known failure modes in a printing system. The embodiments herein utilize customer or service agent input of the defect description, the current machine health, and knowledge from a system diagnostic design and inference engine, and display the example defects at the phase of life as an image on the printer's display screen. The diagnostic image allows for visual verification of diagnostic inference engine or possible final component ambiguity resolution. Finally, the diagnostic image enables a semi-automatic diagnostic plan in the absence of the ideal automatic diagnostic system with zero percent error.

One exemplary method embodiment herein receives printing symptoms from a user into a graphic user interface and receives system information from a printing device exhibiting the printing symptoms. The method analyzes the printing symptoms using a diagnostic inference system operating on a computerized device operatively connected to the graphic user interface to produce candidate component defects. The method outputs diagnostic recommendations containing the candidate component defects to the user. The diagnostic recommendations include at least one representative image of a printing defect corresponding to each candidate component, and probabilities of correctness of the candidate component defects displayed alongside the representative image.

This output of diagnostic recommendations can comprise component replacement, repair, adjustment, etc. Alternatively, the methods herein can loop back through the process and display at least one additional image of at least one additional printing defect using the graphic user interface and receive additional user input regarding similarities between the additional images of the additional printing defects and the printing marks. Further, with some embodiments herein, the analysis performed can produce probabilities of correctness of the candidate component defects, and such probabilities can be displayed alongside the images on the graphic user interface.

In addition, portions herein also include apparatus embodiments. One such exemplary apparatus embodiment includes a computerized device, a graphic user interface operatively connected to (directly or indirectly connected to) the computerized device, and a printing device exhibiting printing symptoms. The graphic user interface receives input of the printing symptoms from a user, and the computerized device receives system information from the printing device.

The computerized device analyzes the printing symptoms and the system information to produce candidate component defects. The computerized device outputs diagnostic recommendations containing the candidate component defects to the user, the diagnostic recommendations include at least one representative image of a printing defect corresponding to each candidate component, and the diagnostic recommendations include probabilities of correctness of the candidate component defects displayed alongside the representative image. The images of the candidate component defects are compared to printing marks on the diagnostic page by the user to confirm the diagnostic recommendations.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
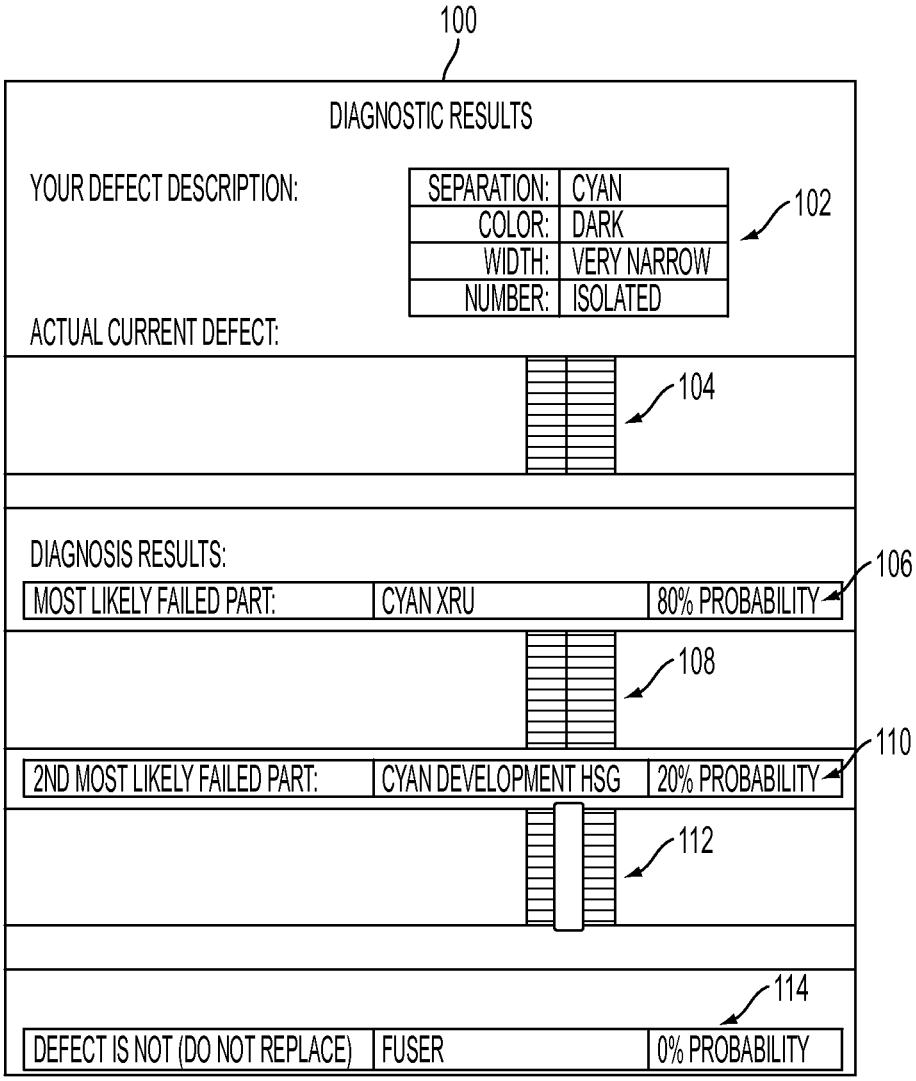
FIG. 1 is a screen shot according to embodiments herein.

In order to aid in future diagnostics relating to printing devices, product development teams have produced standard image references during the final phases of product design. Such standard image references (in the form of user manuals and troubleshooting guide books) provide a diagnostic methodology for use in post-sales service. The standard image references are images that are usually maintained within a reference guide and can be compared to current printed documents (that contain printing errors) to identify which component or components within the printing device may be at fault and creating the printing errors. The primary goal when viewing the standard image references is to evaluate the severity of the defect. Additionally, the service agent or customer may scan through all standard image references created for the printing system to help diagnose and isolate the defective component.

The method disclosed herein automatically generates one or more diagnostic images that illustrate example defects from the most likely components to have failed. The image can be displayed on a monitor, or printed (with the defect in its actual location, and the exemplary defect images at alternate locations on the page).

While diagnostic images have been available previously in user manuals and troubleshooting guidebooks that are often supplied with printing devices, the embodiments herein utilizes such images to supplement the repair recommendations made by a Diagnostic Inference Systems (DIS). Also, the defect images herein are "dynamic" images which show defects at various stages of the printing device's life, and the dynamic images shown are also different based on the current machine health status, component ages, repair history, etc. Diagnostic Inference Systems that output textural recommendations have been used in the past to automatically generate repair recommendations based on manually or automatically detected defects. For example, see U.S. Patent Publication 2008/0294423 (the complete disclosure of which is incorporated herein by reference) for a more detailed discussion of a diagnostic inference system.

Embodiments herein receive input from the user and from the machine regarding a printing defect, and produce possible repair recommendations (in textural form) that may cure the printing defect. In addition, the embodiments herein provide the user with diagnostic images which aid the user in choosing among the possible repair recommendations produced by the Diagnostic Inference System. By providing such diagnostic images, the embodiments herein build upon the results produced by the Diagnostic Inference System and allow the sometimes more highly refined visual abilities of the user to contribute to narrowing the choices of possible repair recommendations, thereby increasing the likelihood that the first chosen repair recommendation will be the correct recommendation that cures the printing defect.

The diagnostic images include visual features and other important diagnostic information deemed important to successfully isolate the defect to the correct faulty component. The diagnostic image includes a visual list of possible faulty components ranked with their likelihood probability based on results from a diagnostic inference engine. The actual defect can be shown, for example, in a stressful half tone patch at the defect location with the exemplary defect images from the possible components shown elsewhere.

Further, with embodiments herein the defect image library contains "dynamic" images which show defects at various stages of the printing device's life, and the dynamic images shown are also different based on the current machine health status, component ages, repair history, etc. Thus, one defect identified by the diagnostic interference system could be represented by many images in the image library, where such different images relate to how the same defect would appear different depending upon the machine's age, repair history, health, etc. Also, negative evidence can be highlighted to indicate what components have a zero probability of curing the printing defect. This diagnostic information is important to alert the customer or service agent not to replace an operational high-valued component (such as a replaceable unit for a single color, when the same defect is evident in multiple separations). An example diagnostic image is shown in FIG. 1.

More specifically, FIG. 1 is an exemplary screen shot or printout 100 that illustrates the defect as described by the user 102. In this example, the defect was described as a cyan separation that has a dark color and a very narrow width, and that was isolated. The actual defect is illustrated as item 104. The diagnose results are shown below the actual defect 104.

One diagnosed result is a defective cyan customer replaceable unit (CRU) which has an 80% calculated probability of being the correct item to repair/replace for this error, as shown by item 106. The diagnostic image resenting the appearance of a printing error caused by a defect with the cyan customer replaceable unit is illustrated as item 108. Note that the diagnostic image 108 closely matches the actual printed error image 104.

A different diagnosed result 110 is included below the first diagnosed result 106. Diagnostic result 110 is to repair/replace the cyan development housing, and has a 20% probability of being the correct item to repair/replace as calculated by the diagnostic inference engine. The diagnostic image of how printing would appear with a defective cyan development housing is illustrated by item 112. Note that the diagnostic image 112 does not closely match the actual printed error image 104.

An additional feature provided by embodiments herein is the diagnosis shown in item 114. This is a negative diagnosis, which indicates that there is a 0% probability that the fuser is defective. This portion of the diagnoses helps avoid replacement of the component that could not be causing the printing defect, thereby saving money, time, and materials by avoiding replacing the incorrect part.

As can be seen in FIG. 1, diagnostic image 112 is not as similar to the actual printing error 104 as is diagnostic image 108. Thus, the exemplary screen shot 100 helps the user/service engineer to identify which part is most likely defective, both by providing percentage probabilities of being the correct part to replace and by providing images of what printing would appear like with such defective parts.

With embodiments herein, the creation of the dynamic diagnostic image is part of a diagnostic system. The image can be generated based on information collected from the customer or service agent once the defect is found, the current machine health status, and a system diagnostic analysis completed during the product design phase and updated as needed. The information use to generate the diagnostic image can be based on a diagnostic inference engine and a library of defect images. The flow diagram shown in FIG. 2 illustrates a diagnostic flow utilizing a dynamic diagnostic image.

Figure 2:
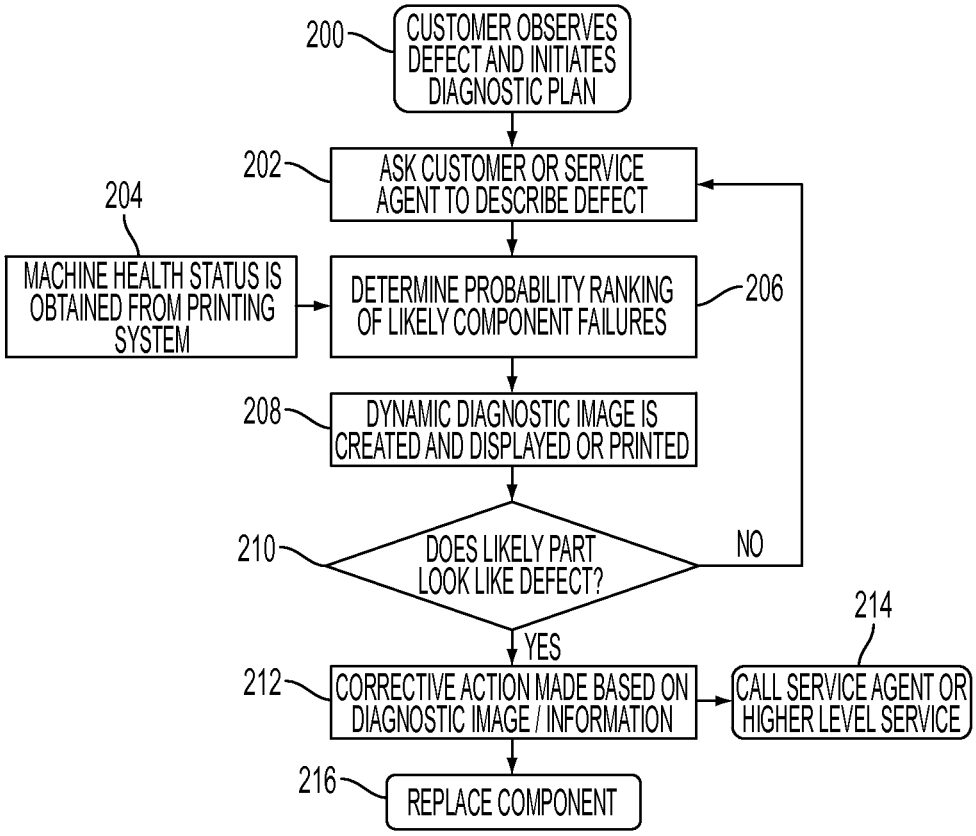
FIG. 2 is a flow diagram according to embodiments herein.

More specifically, in item 200 in FIG. 2, the flow begins when the customer observes a defect and initiates the diagnostic plan (one of the methods herein). In item 202, the customer or the service agent are asked to describe the defect. Item 206 represents the determination of the probability ranking of the likely component failures using, for example, the machine health status that is obtained from the printing system (item 204).

In item 208, the dynamic diagnostic image is created and displayed (or printed). If the defective printing and does not look like any of the diagnostic images, processing returns to item 202 to obtain additional information from the user/service agent. However, if, in item 210, at least one of the diagnostic images does look like the defective printing, processing proceeds to item 212 in which corrective action is output based on the diagnostic image selected by the user/service engineer and based on the information supplied. This allows the embodiments herein to either identify a component that needs to be replaced (item 216) or identify that a service agent needs to be called for a specific higher level of service in item 214.

One aspect of embodiments herein is the process of creating the dynamic image based on the description of the defect, the age of the machine, the repair history of the machine, etc. There are a number of methods that can be used to obtain details of the defect such as a series of questions or a process of automatically using a scan of printed sheets containing defective printing. The embodiments herein obtain as much detail about the defect symptoms/effects to allow the diagnostic inference engine to determine the correct defective component and/or possible component ambiguities.

In other words, while conventional systems may provide guidebooks that are prepared and printed at the time the printing device is manufactured, such guidebooks will not take into consideration various issues that can occur after the printing device has been used in the field for an extended period of time. To the contrary, the embodiments herein consider the age of the printing device, the various repairs that have been made historically to the printing device, tendencies of other, similar printing devices, the "health" of the printing device (the relative operating performance of the components within the printing device) and other factors to create a dynamic image. Because the embodiments herein consider these types of factors, the image that is displayed on a user interface will be the most realistic image that would be produced for the potentially defective part (considering the age of the printing device, the previous repairs made to the printing device, the breakdown tendencies of other similar printing devices, etc.). Thus, for each predicted component failure, the embodiments herein present the user with a very realistic picture of what such a component failure would produce. To the contrary, conventional guide books that are prepared when the printing device is originally manufactured are static and may not correctly match what such a defective component would produce given its age, repair history, health, etc.

Use of such dynamic diagnostic images provides for a visual verification of the results from the diagnostic inference system, which allows another possibility for removing any remaining component ambiguities. A system utilizing the embodiments herein provides for this final human visual verification step to compensate for trade-offs within the total diagnostic system. The visual eye remains one of the most robust sensors and reduces the requirements for other, more expensive automatic detection sensors and reasoning system that are used conventionally.

Two examples of embodiments are presented here. In the first case, the diagnostic image is presented to the user on the machine's user interface. Here, the actual defect could be shown in a limited view to focus attention to the exact defect details and location, while "other system defects" that are not yet discovered by the user remain unseen. The image information of the actual defect could come from a scanned image or Full Width Array Sensor (FWS). Images from the library of the most likely failed components (produced by the DIS) can also be shown in a similar limited view. Finally, the diagnostic image or information display can indicate the components that have zero probability of failure and warnings not to change (in a similar manner as shown in FIG. 1).

A second case utilizing a dynamic diagnostic image can present the image on a printed test page from the printer. This case can be similar in content to the first case (including a limited view of the actual defect) but the images presented from the library of known failure modes can be offset away from the actual defect location on the printed document to allow for the visual comparison. With embodiments herein, the image is modified to account for the possibility that the library images may be confounded with other actual defects in the offset position on a printed document.

Figure 3:
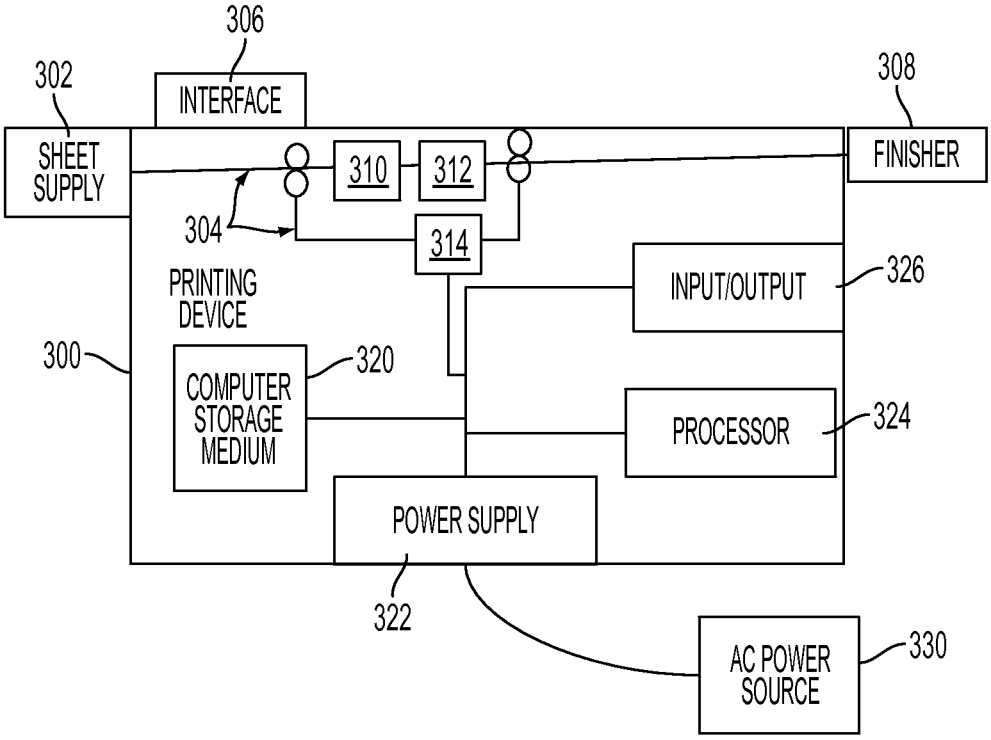
FIG. 3 is a schematic diagram according to embodiments herein.

As shown in FIG. 3, an apparatus printing device embodiment 300 includes a media supply (sheet supply) 302 that feeds sheets along a paper path 304 to various components 310, 312, 314 that can include marking engines, etc., and finally to a finisher unit 308 that performs various finishing functions such as sorting, stapling, folding, bookmaking, etc. The printing device 300 is powered from a power source such as an alternating current (AC) power source 330 which is connected to the printing device's 300 power supply 322.

The processor 324 controls the operations of the printing device 300 and can execute programs of instructions maintained within the computer storage medium 320. The computer storage medium 320 can comprise any known storage medium, such as magnetic, optical, capacitor-based, etc., and the computer storage medium 320 is readable by the processor 324.

The computer storage medium 320 can also maintain the library of images that are utilized by the embodiments herein. As mentioned above, the library of images maintained within the computer storage medium 320 includes many images that relate to each component that could be defective. Therefore, the embodiments herein maintain (within the computer storage medium 320) many different representative images of printing defects for each potentially defective component, so that different images can be presented to the user (for the same potentially defective component) depending upon the age of the printing device, the repair history of the printing device, etc.

Further, the library of images maintained within the computer storage medium 320 can be updated periodically through the input/output 326 that can be connected to a local area network or wide area network. This allows the images within the computer storage medium 320 to be updated based on experiences learned by repairing other, similar printing devices.

Thus, the apparatus embodiment 300 includes a computerized device 324, a graphic user interface 306 operatively connected to (directly or indirectly connected to) the computerized device 324, and a printing device 310, 312, 314 exhibiting printing symptoms. The graphic user interface 306 receives input of the printing symptoms from a user, and the computerized device 324 receives system information from the printing device 310, 312, 314.

The computerized device 324 analyzes the printing symptoms and the system information to produce candidate component defects. The candidate component defects is a list of components that, if defective, could be causing the printing symptoms described by the user. The computerized device 324 outputs diagnostic recommendations containing the candidate component defects to the user (potentially with likelihood probabilities for each component).

The diagnostic recommendations also include at least one representative image of a printing defect corresponding to each candidate component. In other words, instead of merely listing the textual description of which components could potentially be causing the printing symptoms, the embodiments herein also provide an image of what printing would appear like if a specific component were defective. Thus, rather than having the user replace components by starting with the component having the highest probability of successfully curing the printing symptom (and potentially successively working down to lower probability components) the embodiments herein also provide an image corresponding to each potentially defective component to help the user replace the actual component that is causing the printing symptom the first time.

The diagnostic recommendations include probabilities of correctness of the candidate component defects displayed alongside the representative image. The images of the candidate component defects are compared to printing marks on the printed page by the user to confirm the diagnostic recommendations.

Figure 4:
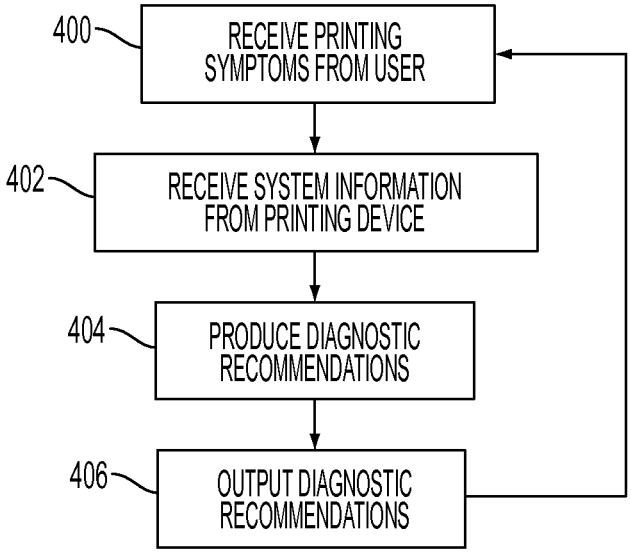
FIG. 4 is a flow diagram according to embodiments herein.

Another exemplary method embodiment herein shown in flowchart form in FIG. 4, where the process begins by receiving printing symptoms from a user into the graphic user interface in item 400. In item 402, the process continues by optionally receiving system information from the printing device that is exhibiting the printing symptoms. The method analyzes the printing symptoms in item 404 using the diagnostic inference system that is operating on the computerized device to produce candidate component defects. The method outputs the diagnostic recommendations containing the candidate component defects to the user in item 406.

Again, the diagnostic recommendations 406 include at least one representative image of a printing defect corresponding to each candidate component, and probabilities of correctness of the candidate component defects displayed alongside the representative image. This output of diagnostic recommendations 406 can comprise component replacement, repair, adjustment, etc. Alternatively, the methods herein can loop back through the process and displays at least one additional image of at least one additional printing defect using the graphic user interface and receive additional user input regarding similarities between the additional images of the additional printing defects and the printing marks on the page, as indicated by the arrow returning to item 400.

A dynamic diagnostic image as described in this disclosure provides the customer the results from a diagnostic inference engine and a visual verification of the current defect compared to a library of defects for the known failure modes in a printing system. The embodiments herein utilize customer or service agent input of the defect description, the current machine health, and knowledge from a system diagnostic design and inference engine. The embodiments herein display example defects at the phase of machine life as the actual defect selected from a library of the known failure modes. The diagnostic image allows for visual verification of diagnostic inference engine or possible final component ambiguity resolution. Finally, the diagnostic image enables a semi-automatic diagnostic plan in the absence of the ideal automatic diagnostic system with zero percent error.

With the embodiments herein, the customer or service agent is presented with more concise information about the likely defective components based on the defect description, machine health, and the system diagnostic analysis. The dynamic diagnostic image allows for a visual verification (and possible final ambiguity resolution) increasing the probability that the correct component has been identified and misdiagnosis is minimized.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data using any custom colors, clear coats, varnish, etc. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

receiving printing symptoms relating to an actual printing defect produced by a printing device from a user into a graphic user interface;

analyzing said printing symptoms using a computerized device operatively connected to said graphic user interface and to said printing device to produce candidate component defects corresponding to said printing symptoms;

creating representative images of example defects by adjusting diagnostic images from a library of diagnostic images illustrating known failure modes, said adjusting changing said diagnostic images to individually compensate for machine age and machine health of said printing device; and outputting diagnostic recommendations containing said candidate component defects to said user, said diagnostic recommendations including an image of said actual printing defect and at least one of said representative images of an example defect corresponding to each of said candidate component defects.

2. The method according to claim 1, said outputting being provided:

through said graphic user interface; or on a printed sheet.

3. The method according to claim 1, said outputting of said diagnostic recommendations comprising one of:

component replacement;

component repair;

component adjustment; and displaying at least one additional image of at least one additional printing defect using said graphic user interface and receiving additional user input regarding similarities between said additional image of said additional printing defect and printing marks on a diagnostic page.

4. The method according to claim 1, said diagnostic recommendations relating to defects of said printing device.

5. A method comprising:

receiving printing symptoms relating to an actual printing defect produced by a printing device from a user into a graphic user interface;

receiving system information from said printing device;

analyzing said printing symptoms using a diagnostic inference system operating on a computerized device operatively connected to said graphic user interface and to said printing device to produce candidate component defects corresponding to said printing symptoms;

creating representative images of example defects by adjusting diagnostic images from a library of diagnostic images illustrating known failure modes, said adjusting changing said diagnostic images to individually compensate for machine age and machine health of said printing device; and outputting diagnostic recommendations containing said candidate component defects to said user, said diagnostic recommendations including an image of said actual printing defect and at least one of said representative images of an example defect corresponding to each of said candidate component defects, said diagnostic recommendations including probabilities of correctness of said candidate component defects displayed alongside said representative image.

6. The method according to claim 5, said outputting being provided:

through said graphic user interface; or on a printed sheet.

7. The method according to claim 5, said outputting of said diagnostic recommendations comprising one of:

component replacement;

component repair;

component adjustment; and displaying at least one additional image of at least one additional printing defect using said graphic user interface and receiving additional user input regarding similarities between said additional image of said additional printing defect and printing marks on a diagnostic page.

8. The method according to claim 5, said diagnostic recommendations relating to defects of said printing device.

9. An apparatus comprising:

a computerized device; and a graphic user interface operatively connected to said computerized device, said graphic user interface receiving printing symptoms relating to an actual printing defect produced by a printing device from a user, said printing device being operatively connected to said computerized device, said computerized device receiving system information from said printing device, said computerized device analyzing said printing symptoms and said system information to produce candidate component defects corresponding to said printing symptoms, said computerized device creating representative images of example defects by adjusting diagnostic images from a library of diagnostic images illustrating known failure modes, said adjusting changing said diagnostic images to individually compensate for machine age and machine health of said printing device, said computerized device outputting diagnostic recommendations containing said candidate component defects to said user, said diagnostic recommendations including an image of said actual printing defect and at least one of said representative images of an example defect corresponding to each of said candidate component defects, and said diagnostic recommendations including probabilities of correctness of said candidate component defects displayed alongside said representative image.

10. The apparatus according to claim 9, said outputting being provided:

through said graphic user interface; or on a printed sheet.

11. The apparatus according to claim 9, said graphic user interface outputting said diagnostic recommendations comprising displaying one of:

component replacement recommendation;

component repair recommendation;

component adjustment recommendation; and at least one additional image of at least one additional printing defect using said graphic user interface and receiving additional user input regarding similarities between said additional image of said additional printing defect and printing marks on a diagnostic page.

12. The apparatus according to claim 9, said analyzing further producing probabilities of correctness of said candidate component defects, and said outputting diagnostic recommendations further comprising displaying said probabilities on said graphic user interface.

13. A non-transitory computer storage medium readable by computer, said computer storage medium storing instructions executable by a computerized device, said instructions causing said computerized device to perform a method comprising:

receiving printing symptoms relating to an actual printing defect produced by a printing device from a user into a graphic user interface;

analyzing said printing symptoms using a computerized device operatively connected to said graphic user interface and to said printing device to produce candidate component defects corresponding to said printing symptoms;

creating representative images of example defects by adjusting diagnostic images from a library of diagnostic images illustrating known failure modes, said adjusting changing said diagnostic images to individually compensate for machine age and machine health of said printing device; and outputting diagnostic recommendations containing said candidate component defects to said user, said diagnostic recommendations including an image of said actual printing defect and at least one of said representative images of an example defect corresponding to each of said candidate component defects.

14. The non-transitory computer storage medium according to claim 13, said outputting being provided:

through said graphic user interface; or on a printed sheet.

15. The non-transitory computer storage medium according to claim 13, said outputting of said diagnostic recommendations comprising one of:

component replacement;

component repair;

component adjustment; and displaying at least one additional image of at least one additional printing defect using said graphic user interface and receiving additional user input regarding similarities between said additional image of said additional printing defect and printing marks on a diagnostic.

16. The non-transitory computer storage medium according to claim 13, said diagnostic recommendations relating to defects of a printing device.

* * * * *